US007479068B2

(12) United States Patent
Ray

(10) Patent No.: US 7,479,068 B2
(45) Date of Patent: Jan. 20, 2009

(54) GOLF SWING TRAINING DEVICE

(76) Inventor: Lynn Ray, 10854 E. Cloudview Ave., Gold Canyon, AZ (US) 85218

( * ) Notice: Subject to any disclaimer, the term of this patent is extended or adjusted under 35 U.S.C. 154(b) by 3 days.

(21) Appl. No.: 11/425,104

(22) Filed: Jun. 19, 2006

(65) Prior Publication Data

US 2006/0287122 A1 Dec. 21, 2006

Related U.S. Application Data

(60) Provisional application No. 60/692,050, filed on Jun. 17, 2005.

(51) Int. Cl.
*A63B 69/36* (2006.01)
*A63B 57/00* (2006.01)

(52) U.S. Cl. ..... 473/226; 473/228; 150/160

(58) Field of Classification Search ..... 473/219, 473/226, 228, 229; 150/160
See application file for complete search history.

(56) References Cited

U.S. PATENT DOCUMENTS 3,023,795 A * 3/1962 Denkert ..... 150/160
4,444,396 A 4/1984 Wendt
5,284,194 A * 2/1994 Gaffney ..... 150/160
5,322,105 A * 6/1994 Meek ..... 150/160
5,394,914 A * 3/1995 Meek ..... 150/160
5,769,141 A * 6/1998 Rinehard ..... 150/160
D402,728 S * 12/1998 Stutzman ..... D21/754
6,138,727 A * 10/2000 Shih ..... 150/160
6,193,063 B1 * 2/2001 Malkoff ..... 206/315.2
6,230,886 B1 * 5/2001 Bradshaw ..... 206/315.2
6,358,157 B1 3/2002 Sorenson
6,772,811 B1 * 8/2004 Kim ..... 150/160

* cited by examiner

*Primary Examiner*—Nini Legesse
(74) *Attorney, Agent, or Firm*—Schmeiser Olsen & Watts LLP

(57) ABSTRACT

A golf swing training device for improving muscle strength and club head speed. A golf swing training device comprising: a head cover, wherein the head cover further comprises a closure flap; at least one air catch coupled to the head cover, wherein the at least one air catch allows air to flow through; and a sock coupled to the at least one air catch. Alternate embodiments comprising: a head cover, wherein the head cover further comprises a closure flap; and at least one air catch coupled to the head cover wherein the at least one air catch comprises a pocket. Further embodiments comprising: a head cover, wherein the head cover further comprises an opening which allows a club shaft to pass through; at least one air catch coupled to the head cover; and a sock coupled to the at least one air catch.

19 Claims, 7 Drawing Sheets

GOLF SWING TRAINING DEVICE

This application claims priority to U.S. Provisional Application Ser. No. 60/692,050, filed Jun. 17, 2005, by Lynn Ray and entitled "GOLF SWING TRAINING DEVICE", which is incorporated herein by reference in its entirety.

BACKGROUND OF THE INVENTION

1. Technical Field

This invention relates to a golf swing training device for improving the strength and club head speed in a golfer's swing.

2. Background Art

Golf is a very popular sport in the United States as well as abroad. Each year golfers spend millions of dollars on different aids to improve their golf swings.

Presently there are many different golf swing strength training devices. For example, U.S. Pat. No. 6,358,157 describes a golf swing strength trainer having a shaft of length not greater than that of a standard golf club shaft. A golf grip is fixed to one end of the shaft. A golf club head is fixed to the other end of the shaft. A pair of substantially equal weights is fixed concentrically on the shaft, one on each end of the grip, the center of gravity of the weights taken together being located substantially at a lengthwise center of the grip. Preferably, the weights abut the opposite ends of the grip.

Another golf swing strength trainer as described in U.S. Pat. No. 4,444,396 consists of an exercise device for improving a golf swing comprising a grip on an upper end of a shaft, a series of perforated circular discs weighing one, two, four, eight and sixteen ounces, respectively, adapted to fit securely on the shaft, proceeding geometrically in weight and a system for releasably securing any combination of the perforated discs on a lower end of the shaft.

There are still many problems with golf swing strength training aids. For example, golf swing strength trainers that presently exist are heavy and awkward making them difficult to carry to and from the golf course or driving range. Current golf swing strength training aids are independent structures and do not attach to the golfers regular set of golf clubs. The difference between the grip on the golfer's regular clubs and the grip on the golf swing strength training aid may cause the golfer discomfort in switching back and forth between the clubs and the training aid. This discomfort may negatively impact the golfer's entire swing.

Accordingly, what is needed is a golf strength training aid that attaches to the golfer's regular set of clubs and that is light and easy to carry to and from the driving range.

DISCLOSURE OF THE INVENTION

Embodiments of the present invention may provide, among other benefits: increased muscle strength and head speed without the need to purchase and carry a heavy golf swing strength training device that may be uncomfortable for the golfer to use due to the different hand grip and feeling of the training device as compared to the golfer's regular clubs.

A first embodiment of the present invention comprises: a head cover, wherein the head cover further comprises a closure flap; at least one air catch coupled to the head cover, wherein the at least one air catch allows air to flow through; and a sock coupled to the at least one air catch.

A second embodiment of the present invention comprises: a head cover, wherein the head cover further comprises a closure flap; and at least one air catch coupled to the head cover wherein the at least one air catch comprises a pocket.

Another embodiment of the present invention comprises: a head cover, wherein the head cover further comprises an opening which allows a club shaft to pass through; at least one air catch coupled to the head cover; and a sock coupled to the at least one air catch.

Alternate embodiments of a golf swing training device configured according to an embodiment of the present invention may further comprise: the head cover further comprising stretchable sidewalls, the at least one air catch further comprising at least one stiff piece of material, and wherein the at least one air catch and the sock further comprise at least one drag-reducing opening. Further embodiments of a golf swing training device configured according to embodiments of the present invention may further comprise at least one drag reducing opening, wherein the at least one drag-reducing opening can be closed and reopened. Yet other embodiments comprise a golf swing training device wherein the golf swing training device is composed of shape holding material and further comprising at least two air catches symmetrically placed on the head cover. The golf swing training device of the present invention may also comprise the at least one air catch comprising a pocket with an opening facing in a rearward direction.

The foregoing and other features and advantages of the invention will be apparent to those of ordinary skill in the art from the following more particular description of the invention and the accompanying drawings.

BRIEF DESCRIPTION OF THE DRAWINGS

The invention will hereinafter be described in conjunction with the appended drawings where like designations denote like elements, and.

DESCRIPTION OF THE INVENTION

As discussed above, embodiments of the present invention relate to a golf swing training aid which helps to build and tone muscle and increase club head speed. Typically, a golf swing training device configured according to the present invention would be used on a driver. However, the golf swing training device may be used on any club desired.

Figure 1:
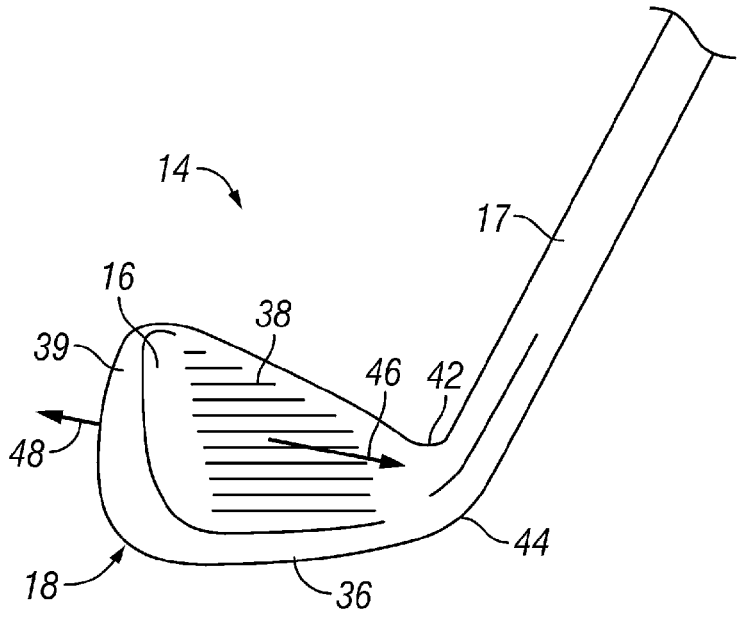
FIG. 1 is a side view of a standard golf club head.

FIG. 1 illustrates a standard golf club 14 that is well known in the art. The club 14 has a shaft 17, grip, and head 18. As shown in FIG. 1 the head 18 has neck 42, heel 44, sole 36, grooves 38, and toe 39. A face 16 of the club head 18 is generally flat and is designed to impact the ball with different angles of incidence. A forward direction is defined by arrow 46. A rearward direction is defined by arrow 48. FIG. 1 will be used further to help describe the present invention.

Figure 2:
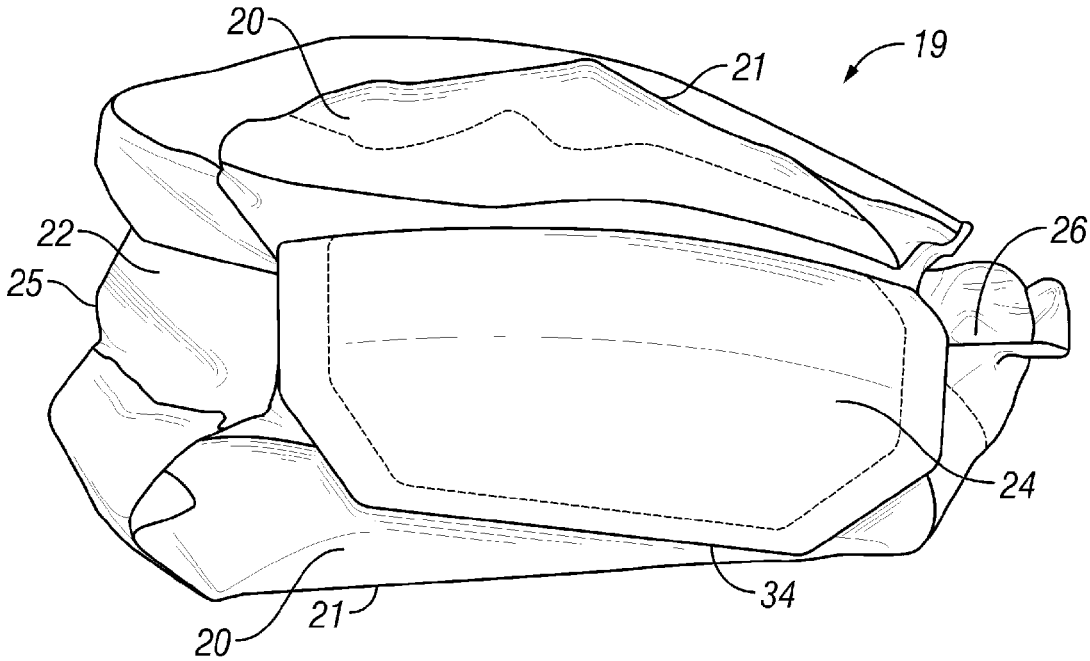
FIG. 2 is a front view of a golf swing training device configured according to a first embodiment of the present invention.
Figure 3:
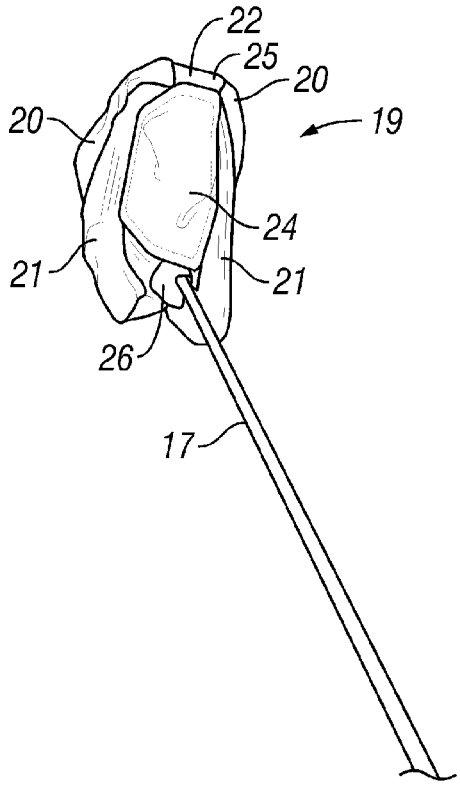
FIG. 3 is a front view of a golf swing training device configured according to a first embodiment of the present invention on a golf club.

FIGS. 2 and 3 illustrate a golf swing training device 19 configured according to a first embodiment of the present invention. The golf swing training device 19 consists of a golf club head cover 25. The head cover 25 is designed to attach the golf swing training device 19 to a golfer's golf club by closing over the head of the golf club. This allows the golfer to increase his muscle strength and club head speed while not having the discomfort of adjusting to a completely different grip, shaft, weight, and club type for the training.

The head cover 25 consists of two head cover side walls respectively. The side walls are shaped to mimic the contour of the club head. The side walls may be formed from any material with the strength and durability to withstand the use required of a golf club training device, such as a heavy fabric material. It may also be desirable to form the side walls of the head cover 25 from a material which partially or rigidly holds its shape in order to provide some structural support to the golf club training device.

The side walls of the head cover 25 are connected approximately seventy-five percent of the way around each side wall's periphery by a strip of stretchable material 22. The stretchable material 22 allows the head cover 25 to stretch in order to fit different size and shapes of golf club heads. The stretchable material 22 should be able to stretch in order to fit the golf club head, while at the same time enduring the stress put on it through repeated use of the golf swing training device 19.

The unconnected twenty-five percent of the head cover 25 periphery forms an opening which accepts a golf club head as it is inserted into the head cover. This opening is secured shut by a closure flap 24. The closure flap 24 is attached to a side wall of the head cover. The closure flap has an attachment device 34 which attaches to the opposite side wall of the head cover 25. By attaching the closure device to the opposite side wall, the head cover 25 is securely closed around the head of the golf club. The closure flap 24 may be formed from the same material as the side walls or it may be formed from any material strong enough to withstand the stresses put on it during use of the golf swing training device 19. The attachment device 34 may be any type of device that will form an attachment to the opposite side wall of the golf swing training device 19 and which is strong enough to withstand the stresses created by use of the golf swing training device 19. In the first embodiment of the present invention, the attachment device 34 is a hook and loop fastener, however, snaps, buttons, zippers, hooks and eyes, laces or any other type of attachment device may be used in order to secure the head cover 25 over the head of the golf club.

An opening 26 is left in the head cover 25 when it is closed in order to allow the golf club shaft 17 to exit through the head cover 25. This opening 26 is created by virtue of the closure flap 24 being smaller than the opening created by the unconnected twenty-five percent of the head cover 25 periphery, so that the closure flap 24 does not cover the entire opening and therefore creates a gap through which the club shaft 17 may pass.

One or more air catches 20 are connected to the head cover 25. The air catches 20 are pockets connected to the side wall of the head cover 25. The air catches 20 have an open end 21 facing in approximately the same direction as the face of the golf club head, the forward direction 46, when the training device 19 is secured to the club head. The sides and the other end of the air catches 20 are closed in order to form a pocket. Alternate embodiments of the one or more air catches 20 may comprise multiple openings. Typically, the open ends 21 of the air catches 20 face the direction of the golfer's forward swing 46, however, if multiple openings are used the open ends may face other directions. The air catches 20 fill up with air as the golfer swings the club. By filling up with air, the air catches 20 act to provide drag on the golf club head like a parachute. This extra drag helps the golfer to gain muscle tone and strength in the muscles that he uses to swing the club. Practicing with extra drag on the club head will also help to increase the golfer's club head speed when swinging the club without the golf swing training device 19 attached. The air catches 20 may be formed of any material that can withstand the force of the air filling the pockets when the golf club is swung. It is preferable, however, to form the air catches 20 from a material which slightly holds its shape in order to have the air catches 20 stand slightly open so that they fill with air during a swing and not collapse under the flow. Air catches 20 should be placed to create symmetrical force on the golf club head. Air catches 20 which are not placed to create symmetrical force on the golf club head may cause a twisting force that causes the golfer to adjust his swing to compensate. In that case, while increasing the golfer's strength, the training device would also alter the swing consistency which is essential to accurate play.

Figure 4:
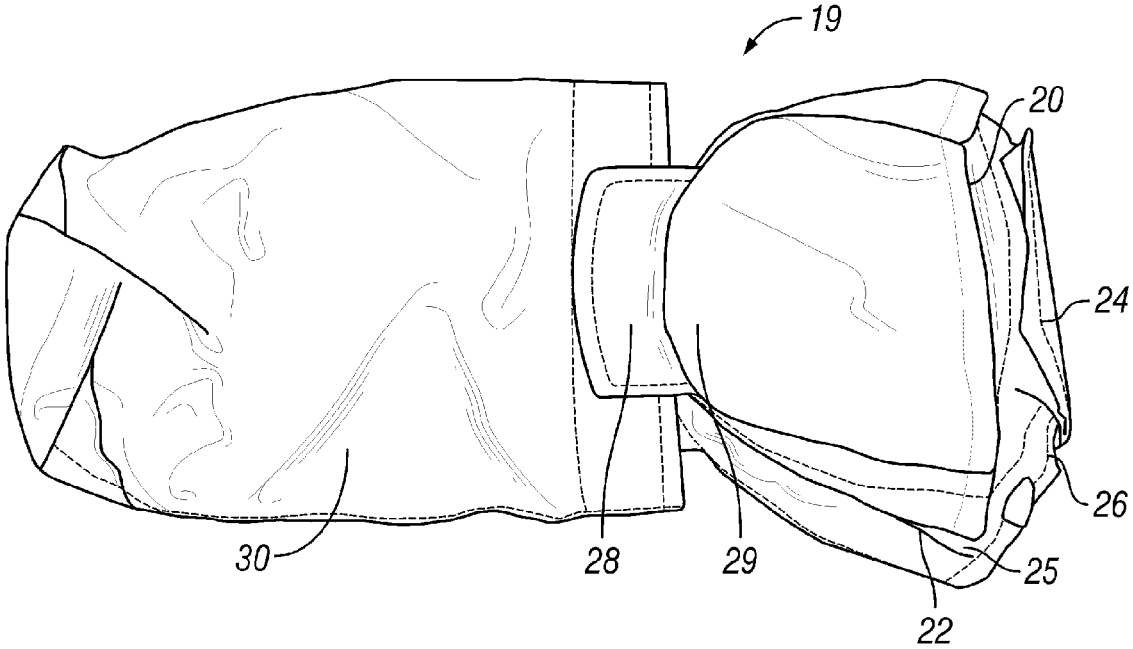
FIG. 4 is a top view of a golf swing training device configured according to a second embodiment of the present invention.
Figure 5:
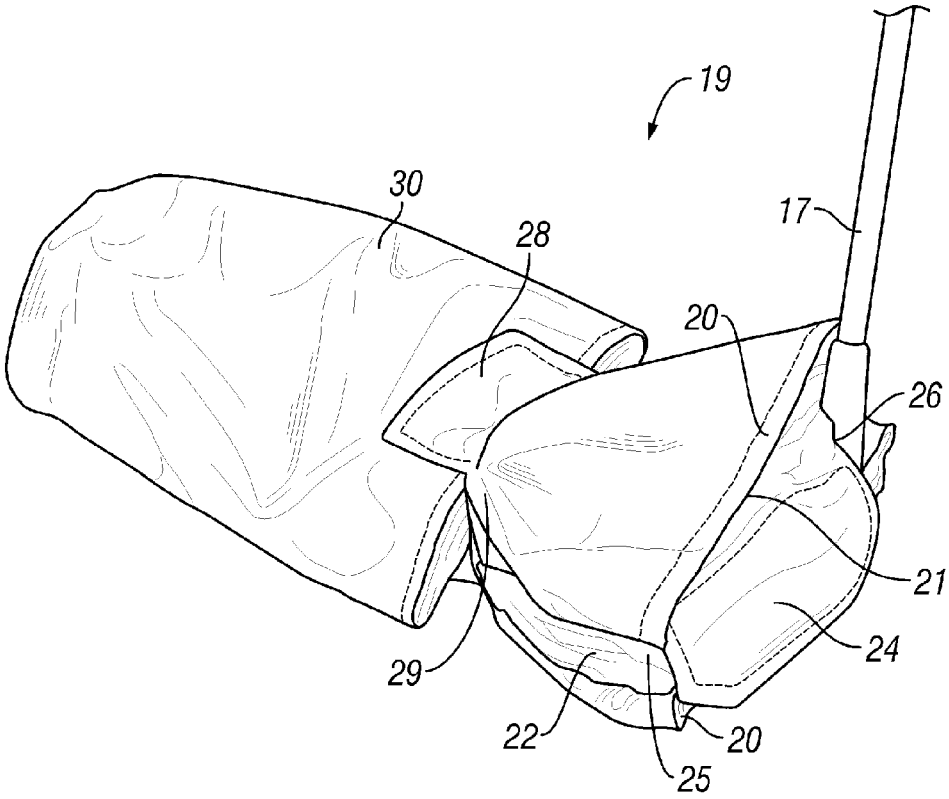
FIG. 5 is a view of a golf swing training device configured according to a second embodiment of the present invention on a golf club.

FIGS. 4 and 5 illustrate a second embodiment of the golf swing training device 19 configured according to the present invention. The second embodiment of the invention contains a head cover 25 as shown in the previous embodiment. The head cover 25 consists of side walls comprising a strip of stretchable material 22. The head cover 25 attaches to the golf club by closing around it through the use of closure flap 24. An opening 26 for the golf club shaft to exit through is also provided in this embodiment of the present invention.

At least one air catch 20 as seen in the previous embodiment is also attached to the head cover 25. However, a sock attachment flap 28 is connected to each air catch 20 at the end of the air catch 20 farthest from the club face 29. The sock attachment flaps 28 connect to an attachment device which attaches the sock attachment flaps 28 to a sock 30. The attachment device may be any form of attachment that provides enough strength to keep the sock from coming loose in use. A hook and loop fastener is used as the attachment device in the second embodiment of the present invention. Hook and loop fasteners, however, may not be strong enough for many golfers and therefore the attachment device should be changed to snaps, zippers or other attachment devices that will provide enough strength to prevent the sock 30 from coming loose when the golf swing training device 19 is in use. It is also possible to permanently attach the sock 30 to the sock attachment flaps 28. The sock attachment flaps 28 are connected to the top of the air catch pockets 20 in order to allow the sock to expand when in use.

Figure 6:
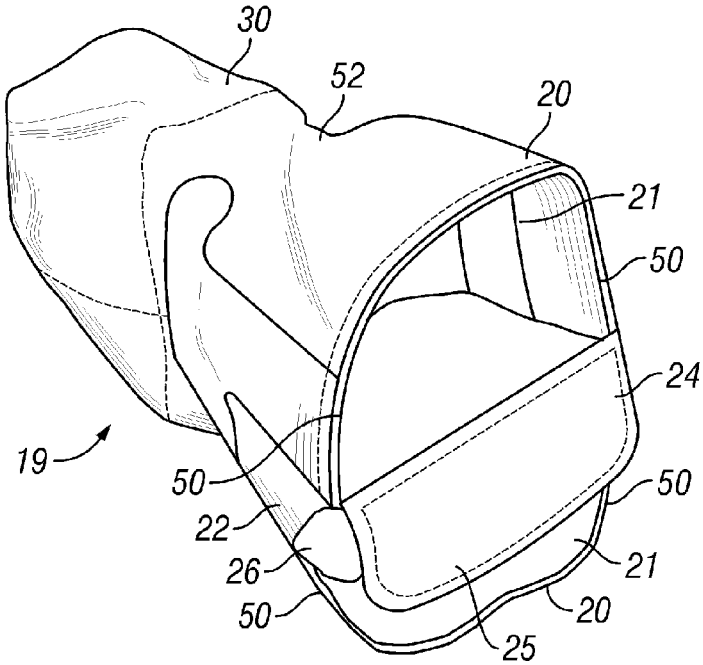
FIG. 6 is an isometric view of a golf swing training device configured according to a third embodiment of the present invention.

FIG. 6 illustrates a third embodiment a golf swing training device configured according to an embodiment of the present invention. The golf swing training device 19 configured according to this embodiment of the present invention comprises at least one air catch 20 coupled to a head cover 25 as described in previous embodiments. Wherein the at least one air catch 20 comprises an opening 21 facing in the forward direction 46 (see FIG. 1). The at least one air catch 20 further comprises an opening in the rearward direction 48 (see FIG. 1), wherein the opening in the rearward direction allows air to flow through the at least one air catch 20 and into a throat area 52. The throat area 52 is slightly narrower than the at least one air catch 20 and the head cover 25 combined. The throat area 52 is further coupled to a sock 30. Air flows through the at least one air catch 20 into the throat area 52 and then through the throat area 52 and into the sock 30. Multiple air catches 20 may be used in order to maximize air flow into the sock 30 and thereby maximize drag on the golf club.

The at least one air catch 20 may be coupled to the throat area 52 permanently or may be removably coupled such as with a zipper, snaps, Velcro or the like. The throat area 52 may be coupled to the sock 30 permanently or may also be removably coupled such as with a zipper, snaps, Velcro or the like.

Embodiments of the present invention may also comprise pieces of stiff material 50 which support the at least one air catch 20 in an open position in order to maximize the air flow through the air catches 20. The stiff piece of material 50 should be the same height as the air catches 20 in order to maximize the amount of drag created by the air catches 20. It is also possible to adjust the drag by inserting different size pieces of stiff materials 50 in the enclosed end of the air catches 20. Alternate shorter pieces of material may replace the stiff piece of material 50 in order to allow the user to adjust the amount of drag if the maximum amount is not desired. Collapsible stiff pieces of material 50 with predetermined folds may also be used so that the user does not have to keep track of multiple pieces of material.

The stiff piece of material may be plastic or any other material that will hold the air catches 20 open and withstand the abuse put on the golf swing training device 19 due to use. The stiff piece of material should not, however, be so heavy that it inhibits the golfer's ability to swing.

Figure 7:
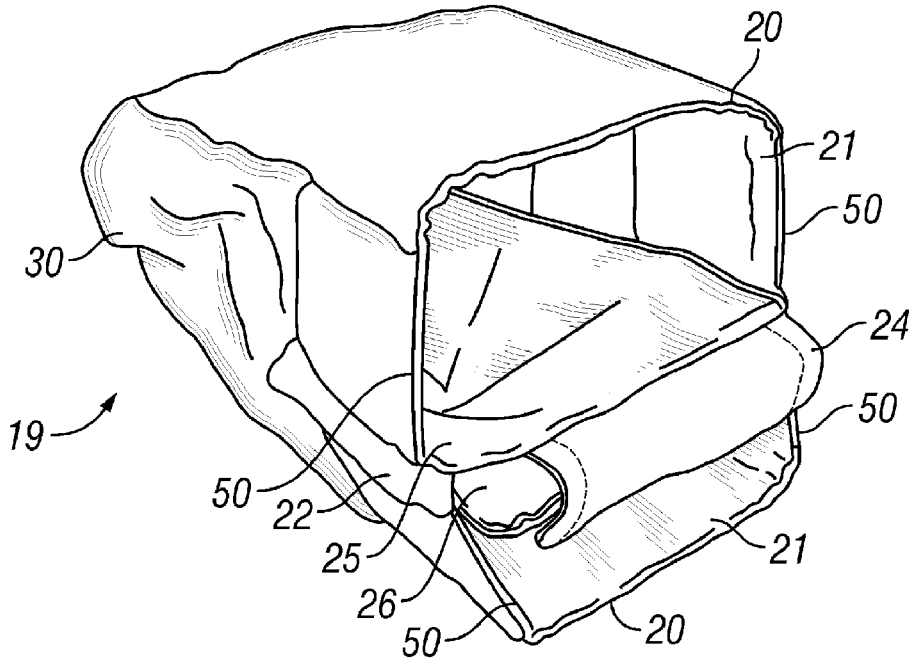
FIG. 7 is an isometric view of a golf swing training device configured according to a fourth embodiment of the present invention.
Figure 8:
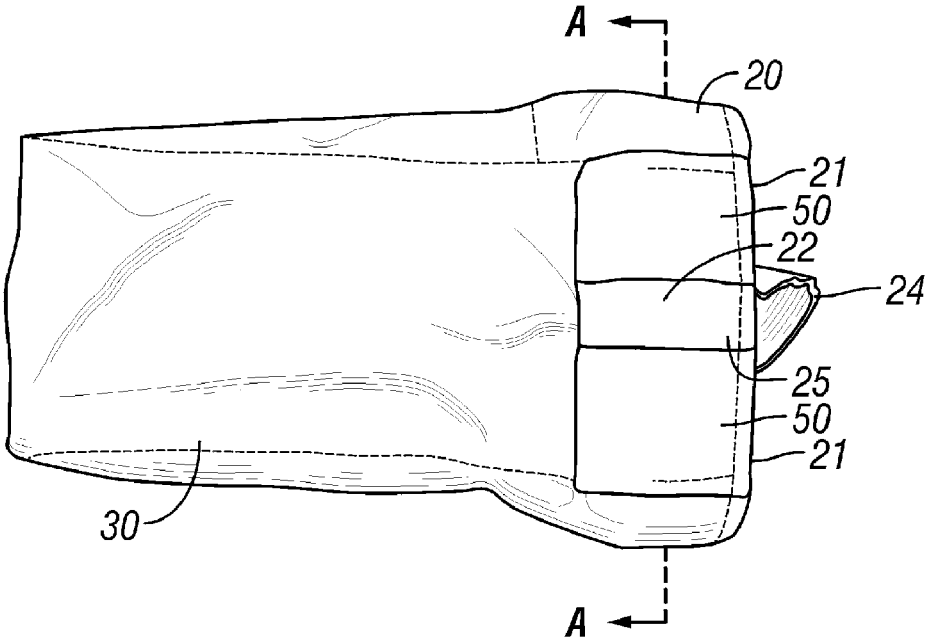
FIG. 8 is a side view of a golf swing training device configured according to a fourth embodiment of the present invention.
Figure 9:
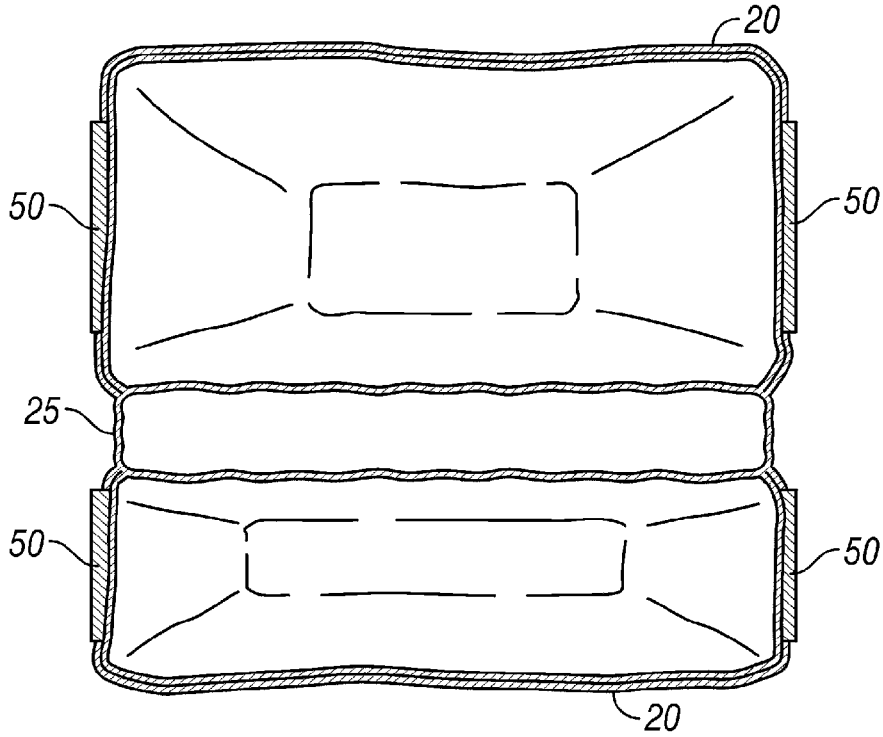
FIG. 9 is a cross-section view along line A-A on FIG. 8 of a golf swing training device configured according to a fourth embodiment of the present invention.

FIGS. 7-9 illustrate a fourth embodiment of a golf swing training device configured according to an embodiment of the present invention. FIG. 9 illustrates a cross sectional view along line A-A on FIG. 8 of an embodiment of the present invention. In this embodiment of the present invention, at least one air catch 20 is coupled to a head cover 25 as described in the previous embodiments. The at least one air catch 20 has an opening 21 in the forward direction 46 as well as in the rearward 48 direction. The at least one air catch 20 is coupled in the rearward direction 48 to a sock 30. Air flows through the at least one air catch 20 and directly into the sock 30. The at least one air catch 20 is held in the open position by pieces of stiff material 50 as described in the previous embodiment.

The at least one air catch 20 may be coupled to the sock 30 permanently or may also be removably coupled such as with a zipper, snaps, Velcro or the like.

An alternate embodiment of the present invention may comprise a sock but not include any air catches. The sock may attach to the golf club through sock attachment flaps similar to that of the second embodiment of the present invention.

The sock 30 is an empty cylindrical pouch or rear air catch that has an open end closest to the golf club head and the opposite end is closed. The sock 30 provides additional drag when the golf club is swung. The sock 30 acts as a parachute and provides additional resistance for golfers who need more resistance than that provided by the first embodiment of this invention.

In other possible embodiments of the present invention, a stiff piece of material may be inserted in the enclosed end of the air catches 20. The stiff piece of material in the enclosed end of the air catches 20 should be the same size as the opening in the air catch 20. The stiff piece of material is then inserted into the air catches 20 and placed at the enclosed end of the air catch 20. The stiff piece of material should be the same height as the air catches 20 in order to maximize the amount of drag created by the air catches 20. It is also possible to adjust the drag by inserting different size pieces of stiff materials in the enclosed end of the air catches 20. Alternate shorter pieces of material may replace the stiff piece of material in order to allow the user to adjust the amount of drag if the maximum amount is not desired. Collapsible stiff pieces of material with predetermined folds may also be used so that the user does not have to keep track of multiple pieces of material.

The stiff piece of material prevents the air catch 20 from collapsing in use. It also forces the sock 30 to open farther in order to more easily fill up with air. The sock attachment flaps 28 are connected to the top of the air catches 20 at the enclosed end. Therefore the stiff piece of material forces the sock attachment flaps 28 farther apart and thereby forcing the open end of the sock 30 wider.

The stiff piece of material may be plastic or any other material that will hold the air catches 20 open and withstand the abuse put on the golf swing training device 19 due to use. The stiff piece of material should not, however, be so heavy that it inhibits the golfer's ability to swing.

It may also be desirable to also place a stiff piece of material at the enclosed end of the sock 30 in order to prevent the sock 30 from being forced closed during use of the golf swing training device 19. The stiff piece of material should be the same height and shape as the closed end of the sock 30 in order to force the sock open as far as possible so that the drag created by the sock 30 is maximized. This piece of stiff material may be removable so that the user may choose whether or not to maximize the amount of drag. Alternate shorter pieces of material may replace the stiff piece of material in order to allow the user to adjust the amount of drag if the maximum amount is not desired. Collapsible stiff piece of material with predetermined folds may also be used so that the user does not have to keep track of multiple pieces of material.

Figure 10:
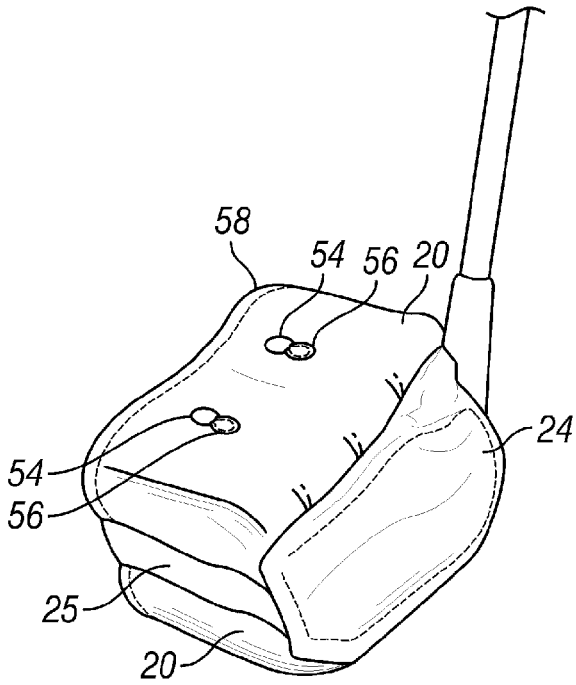
FIG. 10 is an isometric view of a golf swing training device configured according to a fifth embodiment of the present invention.

An alternative embodiment of the present invention may further comprise one or more small drag-reducing openings 54 on the air catches or on the sock as illustrated in FIG. 10. These drag-reducing openings 54 may be adjustable in order to allow the user to adjust the amount of drag created by the golf swing training device 19. The drag-reducing openings 54 could be opened or shut through the use of hook and loop fasteners or some other attachment device 56. The drag-reducing openings 54 could even have drawstrings, flaps or some other device 56 that allows the user to not only completely open or shut the drag-reducing openings 54, but open the openings partway.

In the previously described embodiments of the present invention, the air catches 20 are unidirectional in order to prevent the golf swing training device 19 from hampering the golfer's back swing. This allows the golfer to strengthen and tone the most important muscles used during golf. The strength of a golfer's back swing does not affect the distance the ball travels as much as the strength of the golfer's forward swing. By using a unidirectional golf swing training device 19, the golfer is able to focus on the muscles that will allow him to increase the distance that his ball travels.

As illustrated in FIG. 10, it may also be desirable to have multiple air catches 20 on the golf swing training device 19 with one or more air catches 20 facing the direction of the golfer's back swing or the rearward direction 48 and other air catches facing the direction of the golfer's forward swing 46. This would make it so that the golf swing training device 19 provides drag during the forward and back swing in order to strengthen and tone the muscles used throughout the golfer's entire swing motion.

Figure 11:
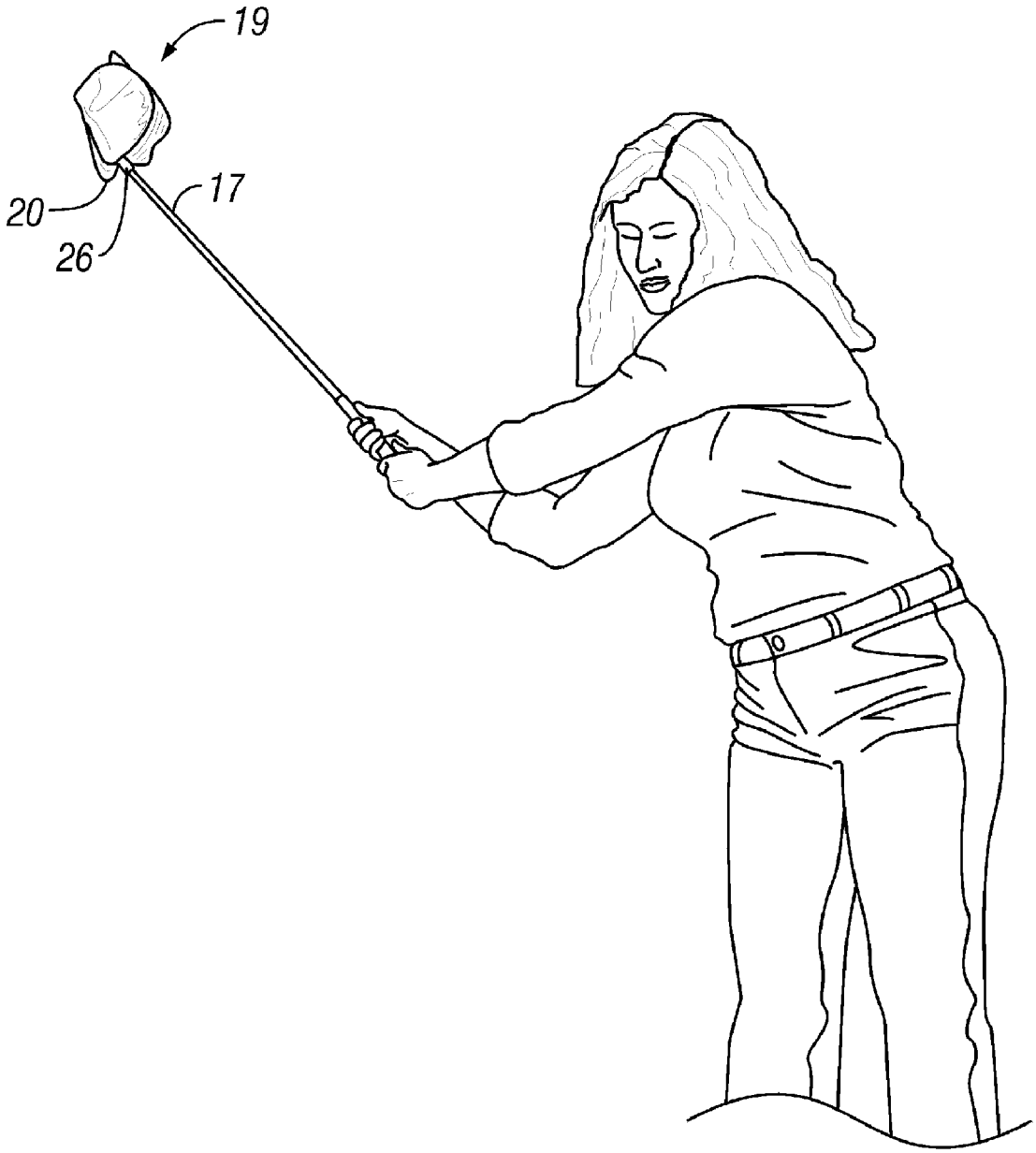
FIG. 11 is a view of a golf swing training device configured according to a first embodiment of the present invention in motion halfway through a swing.

FIG. 11 illustrates the first embodiment of the present invention in use. In FIG. 11 the air catches 20 are inflated as the golf club is swung downwards towards the bottom of the swing. This inflation of the air catches 20 creates drag on the club head causing the golfer to apply additional force to the club shaft 17 in order to bring the club head through the swing. Continued practice using the golf swing training device 19 increases tone and strength in the muscles used in a golf swing. By increasing these muscles, a golfer's stamina will be increased as will the speed of the club head as it is brought through the swing. The faster the club head travels the farther the ball goes.

Figure 12:
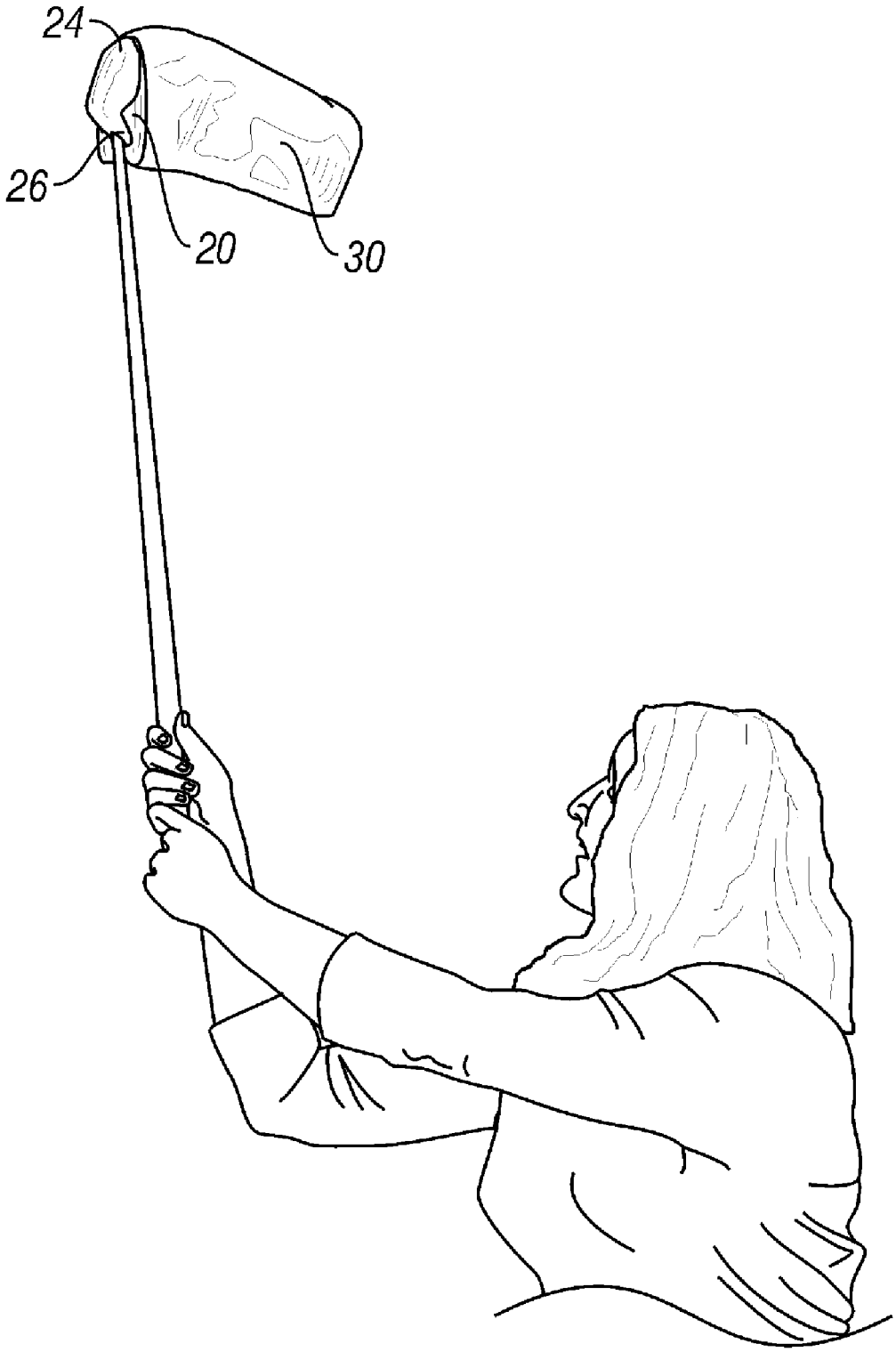
FIG. 12 is a view of a golf swing training device configured according to a fourth embodiment of the present invention on a golf club at the top of a swing.

FIG. 12 illustrates the fourth embodiment of the present invention in use. As the golfer brings the club down through his swing the air catches 20 and the sock 30 fill with air creating additional drag on the club head as it is brought through the swing. As described with reference to the use of the first embodiment of this invention, this drag helps to increase muscle strength and club head speed. The addition of the sock 30 to the first embodiment of the invention adds significantly more drag and will aid strong golfers in increasing their strength, whereas the first embodiment of the present invention may be useful for weaker golfers who need to build their muscle strength.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation.

The invention claimed is:

1. A golf swing training device comprising:

a head cover, wherein the head cover further comprises a closure flap which in the closed position forms an opening through which a golf club shaft exits the head cover;

at least one air catch coupled to the head cover, wherein the at least one air catch allows air to flow through and wherein the at least one air catch further comprises at least one stiff piece of material, the at least one piece of stiff material is the same height as the at least one air catch;

a sock coupled to the at least one air catch, wherein as the golf training device is swung while on a golf club head, the at least one stiff piece of material is positioned either above and/or below the club head; and wherein the at least one stiff piece of material is located at the end of the air catch opposite the sock.

2. The golf swing training device of claim 1 wherein the head cover further comprises stretchable sidewalls.

3. The golf swing training device of claim 2 wherein the at least one air catch comprises a pocket and is connected to the sidewalls.

4. The golf swing training device of claim 1 wherein the at least one air catch and the sock further comprise at least one drag-reducing opening.

5. The golf swing training device of claim 4 wherein the at least one drag-reducing opening further comprises an attachment device for closing.

6. The golf swing training device of claim 4 wherein the at least one drag-reducing opening can be closed and reopened.

7. The golf swing training device of claim 1 wherein the golf swing training device is composed of shape holding material.

8. The golf swing training device of claim 1 further comprising at least two air catches symmetrically placed on the head cover.

9. The golf swing training device of claim 1 wherein the sock is coupled to the at least one air catch by a sock attachment flap.

10. A golf swing training device comprising:

a head cover, wherein the head cover further comprises a closure flap which in the closed position forms an opening through which a golf club shaft exits the head cover; and at least one air catch having an enclosed end and coupled to the head cover wherein the at least one air catch comprises a pocket and at least one piece of stiff material at the open end, wherein the at least one piece of stiff material is the same height as the at least one air catch, and wherein as the golf training device is swung while on a golf club head, the stiff material is positioned above and/or below the club head.

11. The golf swing training device of claim 10 wherein the at least one air catch comprises a pocket with an opening facing in a rearward direction.

12. The golf swing training device of claim 10 wherein the at least one air catch comprises a pocket with an opening facing in a forward direction.

13. The golf swing training device of claim 10 wherein the head cover further comprises sidewalls formed of stretchable material.

14. The golf swing training device of claim 10 wherein the at least one air catch further comprises at least one drag-reducing opening.

15. The golf swing training device of claim 14, wherein the at least one drag-reducing opening is closeable.

16. The golf swing training device of claim 10, further comprising at least two air catches symmetrically coupled to the head cover.

17. A golf swing training device comprising:

a head cover, wherein the head cover further comprises an opening which allows a club shaft to pass through;

at least one air catch having an enclosed end and coupled to the head cover, wherein the at least one air catch further comprises a piece of stiff material at the open end, wherein the at least one piece of stiff material is the same height as the at least one air catch; and a sock coupled to the at least one air catch, wherein as the golf training device is swung while on a golf club head, the stiff material is positioned above and/or below the club head.

18. The golf swing training device of claim 17 wherein the at least one air catch further comprises an opening facing in a rearward direction.

19. The golf swing training device of claim 17 wherein the at least one air catch allows air to flow through into the sock.

* * * * *